US008251192B1

(12) United States Patent
Milani

(10) Patent No.: US 8,251,192 B1
(45) Date of Patent: Aug. 28, 2012

(54) SUITCASE

(76) Inventor: Shahram Milani, University Place, WA (US)

( * ) Notice: Subject to any disclaimer, the term of this patent is extended or adjusted under 35 U.S.C. 154(b) by 94 days.

(21) Appl. No.: 12/807,689

(22) Filed: Sep. 13, 2010

(51) Int. Cl.
*B65D 5/14* (2006.01)

(52) U.S. Cl. ..... 190/103; 190/18 A; 190/111; 206/524.8

(58) Field of Classification Search ..... 190/103, 190/18 A, 110, 111, 109; 206/522, 524.8; 383/3

See application file for complete search history.

(56) References Cited

U.S. PATENT DOCUMENTS

| | | | | |
|---|---|---|---|---|
| 4,142,564 | A | 3/1979 | Zoland | |
| 4,895,230 | A | 1/1990 | King et al. | |
| 5,141,107 | A * | 8/1992 | Wiedermann et al. | 206/287.1 |
| 5,458,164 | A | 10/1995 | Tawil | |
| 5,540,500 | A | 7/1996 | Tanaka | |
| 5,813,527 | A | 9/1998 | Henrickson | |
| 5,881,881 | A | 3/1999 | Carrington | |
| 6,135,253 | A | 10/2000 | Weissmann et al. | |
| 6,499,574 | B1 | 12/2002 | Anthony | |
| 2011/0259693 | A1 * | 10/2011 | Nascarella | 190/18 A |

FOREIGN PATENT DOCUMENTS

JP 7-265116 * 10/1995

* cited by examiner

*Primary Examiner* — Tri Mai
(74) *Attorney, Agent, or Firm* — Paul R. Martin

(57) ABSTRACT

A suitcase has a vacuum system which draws air out of clothing and areas adjacent to clothing being stored in the suitcase.

2 Claims, 1 Drawing Sheet

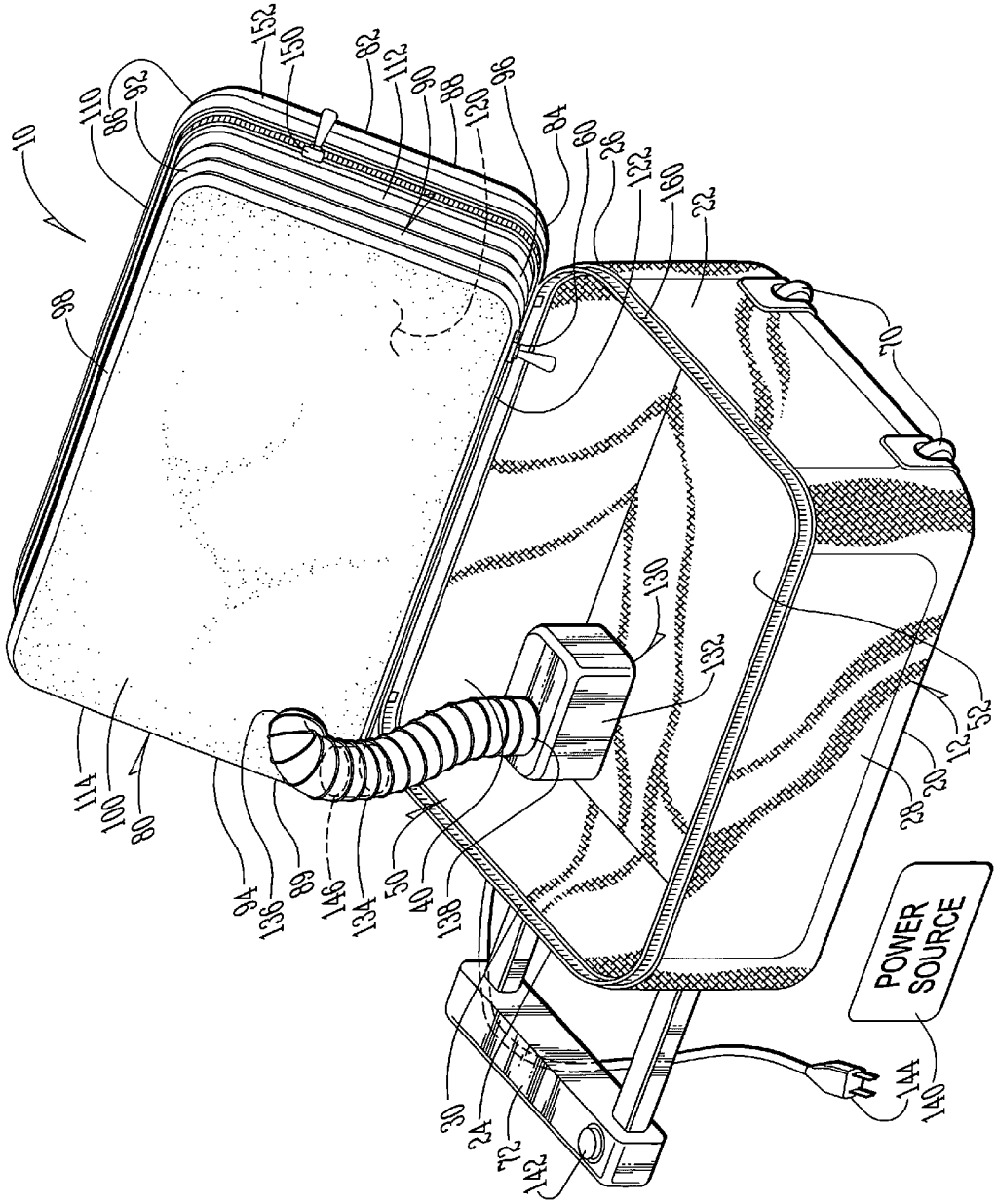
POWER SOURCE

SUITCASE

TECHNICAL FIELD OF THE INVENTION

The present invention relates to the general art of containers, and to the particular field of suitcases.

BACKGROUND OF THE INVENTION

When traveling, the transport of luggage can often be a burdensome ordeal. And, despite the difficulty and inconvenience of having to tote heavy suitcases throughout one's journey, many air travelers prefer to carry their luggage on the plane in order to avoid delays at their destination. The practice of carrying luggage onto the airplane has increased as airlines continue to institute baggage fees. In recent years, however, many airlines have implemented strict policies, limiting the size and number of pieces of luggage which can be carried on the plane. Unfortunately, it is not always easy to fit all of one's items in a small suitcase. Luggage pieces which do not meet the carry-on size limitations must be checked with the airline for storage in the plane's cargo compartments. In addition to delays encountered when waiting for checked luggage, as well as the possibility of losing the luggage, an oversize suitcase is difficult to carry and transport, especially when traveling to more than one destination.

In an attempt to pack more clothing and articles in a smaller suitcase, virtually every traveler has encountered the inevitable battle of zipping closed an overstuffed suitcase. This is a particularly common dilemma for those traveling to colder climates, such as ski destinations, wherein the packed articles of clothing tend to be bulky, such as sweaters, jackets, ski suits, and the like.

In the past, others have developed collapsible storage containers which typically include a flexible, air tight bag, and a fixture through which to evacuate excess air. When the air tight bag has been filled with one or more articles, air is evacuated through the fixture, causing the bag to collapse, thereby compressing the articles therein so that the storage container is easier to transport and store in a smaller space.

Articles of travel for the most part comprise clothing which retains a lot of dead airspace between fibers. As such, articles of clothing take up an inordinate amount of space in a suitcase. To effectively store articles of travel, the user generally must depress the articles of travel manually or apply a force by hand to said articles of travel in order to minimize their volume. The elastic forces of the fibers of clothing does not allow the clothing to retain a minimum storage configuration without some additional manual force applied to compress them into the storage chambers of the apparatus. This can sometimes lead to loss of neatness, winkling and rumpling of clothing, a situation every traveler must contend with. To solve this problem, some ideas have been developed by others that rely on separately storing clothing in pre-made vacuum bags that can compress the clothing when a vacuum is applied to them. These bags are separate from the suitcase and have no formal shape or design intent other than storing individual clothing item in a pre-compressed state for later storage in a suitcase. Thus several such bags are need to store articles of travel effectively. Further, the separate storage bag systems are designed to be rolled into a cylinder by hand, with the stored articles of clothing in them, so that so that all air is removed from the stored articles of clothing. This can cause wrinkling, rumpling and undesired results when suits and other sensitive clothes that must be stored wrinkle-free are stored using such systems. Further they do not form a simple single integrated system for storing articles of clothing, and are generally bought separately from the suitcases. Further, when such existing systems are used to store clothing in a suitcase, they can move about in the suitcase and offer no anchoring system for the clothing stored in them, so that their efficiency in keeping clothes wrinkle free during storage diminishes considerably. The present invention allows the user to have all the advantages of effective and efficient storage of clothing and other articles of travel, without the disadvantages outlined above. Further, the present invention is a simple and unified method of storing articles of travel in a suitcase without the disadvantages and inconvenience of using separate bags and containers for the same. Further, the apparatus of the present invention allows all the articles of clothing stored inside a suitcase to be kept together and neatly in the confines of the suitcase with little or no wrinkling.

Furthermore, once a trip is completed, a traveler often has a great deal of soiled clothing and some clean clothing. Many travelers do not wish to store soiled clothing and clean clothing in the same storage area as soiled clothing may have an odor which may permeate into the clean clothing. Therefore, many travelers place soiled clothing in bags that are then placed in the suitcase. This is a slight improvement on the situation where all clothing is stored together, but much improvement is still needed.

Accordingly, there is a need for a suitcase having a collapsible packing system therein to thereby increase the holding capacity of the suitcase.

SUMMARY OF THE INVENTION

The above-discussed disadvantages of the prior art are overcome by a suitcase having a vacuum system which draws air out of clothing and areas adjacent to clothing being stored in the suitcase. Removing extraneous air from the suitcase allows more clothing to be packed into the suitcase than in known suitcases.

The suitcase can store as much, and perhaps more, than a full size luggage piece but once packed, can be shrunk to fit into an air plane overhead compartment. It works similar to existing space saving storage bags, such as disclosed in U.S. Pat. Nos. 5,540,500 and 5,881,881, the disclosures of which are incorporated herein by reference, which use vacuum suction to compact garments. The luggage can include a battery-powered vacuum system for removing air from the luggage.

Soiled clothing can be placed in the storage pocket and when air is withdrawn, any odors associated with the soiled clothing will be drawn out of the suitcase and the soiled clothing is not likely to degrade any clean clothing that may also be stored in the suitcase.

Other systems, methods, features, and advantages of the invention will be, or will become, apparent to one with skill in the art upon examination of the following FIGURE and detailed description. It is intended that all such additional systems, methods, features, and advantages be included within this description, be within the scope of the invention, and be protected by the following claims.

BRIEF DESCRIPTION OF THE DRAWING FIGURE

The invention can be better understood with reference to the following drawing and description. The components in the FIGURE are not necessarily to scale, emphasis instead being placed upon illustrating the principles of the invention. Moreover, in the FIGURE, like referenced numerals designate corresponding parts throughout the view.

FIG. 1 is a perspective view of a suitcase embodying the present invention in the open condition.

DETAILED DESCRIPTION OF THE INVENTION

Referring to the FIGURE, it can be understood that the present invention is embodied in suitcase 10 which comprises an outer shell 10 in which clothing is stored. The outer shell includes a first wall 20, first and second end walls 22 and 24, and first and second side walls 26 and 28. The end and side walls each has a top rim, such as top rim 30 of end wall 24. Each of the walls has a surface, such as surface 40 of side wall 26, which is an inner surface when the outer shell is in use. The walls are arranged with respect to each other so the inner surfaces of the walls define a storage area 50 which receives and stores clothing when in use. The top rims are all co-planar with each other and define an open passage 52 into the storage area. A flexible flap 60 is movably mounted on inner surface 40 of first side wall 26 to be located inside storage area 50 adjacent to the top rim of first side wall 26. The purpose and operation of flap 60 will be understood from the teaching of the present disclosure.

Wheels 70 are mounted on end wall 22 and a handle 72 is mounted on end wall 24, with the use and function of the wheels and handle being well known.

Suitcase 10 further comprises a cover 80 which includes a first surface 82 which is an outer surface when the cover is in use, a first side edge 84 which is pivotally attached to the rim of first side wall 26 so the cover moves between an open position spaced apart from open passage 52 and a closed position covering the open passage and closing the storage area. The cover is shown in the open position in FIG. 1. Cover 80 further includes a second edge 86 which abuts the rim of second side wall 28 when the cover is in the closed position. Cover 80 further includes first and second end edges 88 and 89 which are located adjacent to first and second ends 22 and 24 respectively of the outer shell when the cover is in the closed position.

An expandable/collapsible storage pocket 90 is mounted on the cover to be located inside the storage area when the cover is in the closed position. The storage pocket has first and second end edges 92 and 94 which abut the inner surfaces of the first and second end walls of the outer shell respectively adjacent to the rims of the first and second end walls of the outer shell respectively when the cover is in the closed position. Storage pocket 90 further includes a first side edge 96 which is located adjacent to first side edge 84 of the cover, a second side edge 98 which is located closely adjacent to second side edge 86 of the cover, and a pocket wall 100 which is spaced apart from the cover.

Pocket 90 further includes a side wall 110 which connects second side edge 98 of the pocket to second side edge 86 of the cover. Side wall 110 of the pocket is pleated to be expandable and collapsible. Pocket 90 further includes a first end wall 112 connecting first end edge 92 of the pocket to first end edge 88 of the cover, with first end wall 112 of the pocket being pleated to be expandable and collapsible. A second end wall 114 of the pocket connects second end edge 94 of the pocket to second end edge 89 of the cover with second end wall 114 of the pocket being pleated to be expandable and collapsible.

Pocket wall 100, pocket side wall 110 and pocket end walls 112 and 114 define an interior storage area 120 of the pocket. The purpose of interior storage area 120 will be understood from the teaching of this disclosure.

First side edge 96 of the pocket is movable between a first position closely adjacent to the first side edge of the cover and a second position spaced apart from the first side edge of the cover so that an opening 122 into the interior storage area of the pocket is defined adjacent to the first side edge of the pocket when the pocket is in the second position. The first side edge of the pocket is shown in the second position thereof in FIG. 1.

First side edge 96 of the pocket is located closely adjacent to flap 60 mounted on first side wall 26 of the outer shell. The flap is movable between a first position spaced apart from the first side edge of the pocket and a second position covering the first side edge of the pocket when the cover is also in the closed position to sealingly close the pocket in an airtight manner. Flap 60 may be of the type well known to those skilled in the container art, and may be of the type used on Zip-loc® Bags with one portion of the zipper being fixed to the flap and a second portion of the zipper being fixed to wall 100 of the pocket and the two zipper portions being releasably zipped together to seal the flap to the pocket in an airtight manner.

Pocket 90 is adapted to contain clothing for storage in the outer shell in the manner of a compartment of a suitcase. However, as discussed above, clothing generally contains a great deal of air and thus has will take up a volume in the suitcase much larger than necessary for safe and secure packing.

Thus, suitcase 10 contains means to remove as much of this air as possible whereby great amounts of clothing can be stored in suitcase 10 as compared to known suitcases.

Suitcase 10 further comprises a vacuum system 130 which includes a vacuum unit 132 located in the storage area of the outer shell. A vacuum hose 134 is connected at one end 136 thereof to the pocket wall and fluidically to the interior storage area of the pocket, the vacuum hose has a second end 138 fluidically connected to the vacuum unit so the vacuum unit is fluidically connected to the interior storage area of the pocket to draw air out of the interior storage area of the pocket when the vacuum unit is activated. A power source 140, such as a battery or the like, is connected to the vacuum unit via a control switch 142 mounted on the handle to control operation of the vacuum unit. The power source can be located spaced apart from the suitcase, as a wall outlet which is connected to the suitcase by means of a plug 144, or it can be a battery pack located spaced apart from the suitcase or on the suitcase. A one-way valve 146 is located in hose 134 so that air withdrawn from the pocket will not flow back into the pocket during the vacuum operation or after the vacuum system is stopped. The precise details of the one-way valve are not important to this disclosure and thus will not be presented or claimed. However, a one-way valve is disclosed in U.S. Pat. No. 5,480,030 and the disclosure of this patent is incorporated here by reference.

A zipper 150 can be located in outer surface 152 of cover 90 so storage compartments can be located on the outside of the suitcase. The zipper may also be used to relieve tension on the outer surface of the cover so more items can be packed in the suitcase by unzipping the zipper to relax the outer surface of the suitcase. Furthermore a zipper 160 is located on the outer surfaces of the side and end walls of the outer shell and on the cover so the cover can be releasably attached to the outer shell in the manner of a suitcase. Wheels 70 and handle 72 can be retractable in the manner of known suitcases.

A vacuum is drawn on the interior storage area of the pocket when the flap is closed over the first side edge of the pocket and sealingly closes the first side edge and the vacuum unit is activated so that the pocket wall is drawn toward the cover when the vacuum unit is activated whereby of overall volume of the interior storage area is reduced. The outside dimensions of the outer shell are similar to those associated with carry-on luggage that is stored in the overhead rack of an airplane. However, the pocket expands to a size much greater than that to for packing. Once packed, the pocket is closed using flap 60, vacuum system 130 activated and air is withdrawn the pocket. As air is withdrawn from pocket 90, it shrinks to a size that can be easily stored in the storage area 50 of the outer shell. Thus, suitcase 10 will be able to store as much, and perhaps more, clothing than a full size suitcase, yet will be a size that can be carried onto the airplane and stored in an overhead compartment. It is also noted that any volume in the storage area 50 that is adjacent to housing 132 may be used for storage outside pocket 90. Therefore, toiletries or clothing can be located in the volume between pocket wall 100 and outer shell wall 20 in the space created because pocket wall 100 abuts housing 132 and is thus spaced apart from wall 20. For example, on a return trip, a traveler can store soiled clothing in pocket 100 and clean clothing in the area between wall 100 and wall 20 with the vacuum sealed pocket keeping any odors associated with the soiled clothing from permeating into the clean clothing. The situation can be reversed as well, with the soiled clothing be placed in the area between walls 20 and 100 and clean clothing being stored in the pocket. Aromatic items, such as deodorant, perfume or after shave lotion or the like can also be stored in the area between walls 20 and 100 so the aroma associated therewith does not permeate into clothing stored in the pocket. Those skilled in the art will understand many other variations based on the teaching of this disclosure, and such additional variations are considered to be within the purview and teaching of this disclosure and the claims associated therewith.

While various embodiments of the invention have been described, it will be apparent to those of ordinary skill in the art that many more embodiments and implementations are possible within the scope of this invention. Accordingly, the invention is not to be restricted except in light of the attached claims and their equivalents.

What is claimed is:

1. A suitcase comprising:

A) an outer shell which includes
- (1) a first wall,
- (2) first and second end walls,
- (3) first and second side walls,
- (4) the end and side walls each having a top rim,
- (5) each of the walls having a surface which is an inner surface when the outer shell is in use,
- (6) the walls being arranged with respect to each other so the inner surfaces of the walls define a storage area,
- (7) the top rims all being co-planar with each other and defining an open passage into the storage area, and
- (8) a flexible flap movably mounted on the inner surface of the first side wall to be located inside the storage area adjacent to the top rim of the first side wall;

B) wheels mounted on one end wall;

C) a handle mounted on another end wall;

D) a cover which includes
- (1) a first surface which is an outer surface when the cover is in use,
- (2) a first side edge which is pivotally attached to the rim of the first side wall of the two side walls of the outer shell so the cover moves between an open position spaced apart from the open passage and a closed position covering the open passage and closing the storage area,
- (3) a second edge which abuts the rim of the second side wall of the outer shell when the cover is in the closed position,
- (4) first and second end edges which are located adjacent to the first and second end walls of the outer shell respectively when the cover is in the closed position, and
- (5) an expandable/collapsible storage pocket which is mounted on the cover to be located inside the storage area when the cover is in the closed position, the storage pocket having
  - (a) first and second end edges which abut the inner surfaces of the first and second end walls of the outer shell respectively adjacent to the rims of the first and second end walls of the outer shell respectively when the cover is in the closed position,
  - (b) a first side edge which is located adjacent to the first side edge of the cover,
  - (c) a second side edge which is located closely adjacent to the second side edge of the cover,
  - (d) a pocket wall which is spaced apart from the cover,
  - (e) a side wall connecting the second side edge of the pocket to the second side edge of the cover, the side wall of the pocket being pleated to be expandable and collapsible,
  - (f) a first end wall connecting the first end edge of the pocket to the first end edge of the cover, the first end wall of the pocket being pleated to be expandable and collapsible,
  - (g) a second end wall connecting the second end edge of the pocket to the second end edge of the cover, the second end wall of the pocket being pleated to be expandable and collapsible,
  - (h) the pocket wall, the pocket side wall and the pocket end walls defining an interior storage area of the pocket,
  - (i) the first side edge of the pocket being movable between a first position closely adjacent to the first side edge of the cover and a second position spaced apart from the first side edge of the cover so that an opening into the interior storage area of the pocket is defined adjacent to the first side edge of the pocket when the pocket is in the second position,
  - (j) the first side edge of the pocket being located closely adjacent to the flap mounted on the first side wall of the outer shell, the flap being movable between a first position spaced apart from the first side edge of the pocket and a second position covering the first side edge of the pocket when the cover is also in the closed position to sealingly close the pocket in an airtight manner, and
  - (k) the pocket being adapted to contain clothing for storage in the outer shell in the manner of a compartment of a suitcase; and E) a vacuum system which includes
- (1) a vacuum unit located in the storage area of the outer shell,
- (2) a vacuum hose connected at one end thereof to the pocket wall and fluidically to the interior storage area of the pocket, the vacuum hose having a second end fluidically connected to the vacuum unit so the vacuum unit is fluidically connected to the interior storage area of the pocket to draw air out of the interior storage area of the pocket when the vacuum unit is activated, (3) a power source, and (4) a control switch mounted on the handle and electrically connected to the power source and to the vacuum unit to control operation of the vacuum unit;

F) a vacuum being drawn on the interior storage area of the pocket when the flap is closed over the first side edge of the pocket and sealingly closes the first side edge and the vacuum unit is activated so that the pocket wall is drawn toward the cover when the vacuum unit is activated whereby of overall volume of the interior storage area is reduced.

2. The suitcase defined in claim 1 further including a zipper located on first surface of the cover.

* * * * *